United States Patent [19]

Ngadi et al.

[11] Patent Number: 4,706,955

[45] Date of Patent: Nov. 17, 1987

[54] RACKET FRAME CLAMP FOR STRINGING MACHINE

[76] Inventors: Sumiaty Ngadi, 130, 192 Lane, Sec 1, Fung Hsing Rd, Tan Tzu; David T. Chu, 150, Chung Chen Rd., both of Taichung, Taiwan

[21] Appl. No.: 865,134

[22] Filed: May 20, 1986

[51] Int. Cl.[4] ..... A63B 51/14

[52] U.S. Cl. ..... 273/73 A; 269/227; 269/238

[58] Field of Search ..... 273/73 R, 73 A, 73 B; 269/227, 238; 29/261, 262

[56] References Cited

U.S. PATENT DOCUMENTS

| | | | |
|---|---|---|---|
| 2,109,740 | 3/1938 | Carlborg | 29/261 |
| 2,380,661 | 7/1945 | Marsilius | 269/227 |
| 2,961,900 | 11/1960 | Stanton et al. | 269/227 |
| 3,441,275 | 4/1969 | Held | 273/73 A |
| 4,620,705 | 11/1986 | Tsuchida | 273/73 A |

FOREIGN PATENT DOCUMENTS

| | | | |
|---|---|---|---|
| 0136245 | 4/1985 | European Pat. Off. | 273/73 A |

*Primary Examiner*—Richard C. Pinkham
*Assistant Examiner*—Matthew L. Schneider
*Attorney, Agent, or Firm*—Holman & Stern

[57] ABSTRACT

A racket stringing machine comprises a support frame, a tension head assembly, a lateral clamp head and a longitudinal clamp head. Movement of the tension head assembly is controlled by a brake motor which is controlled by the signals transferred from a limit switch. The limit switch is normally pressed by a contact element and released when a string clamp head pivoted on the tension head assembly is spring biassed to pivot away from the clamping frame and a contact element fixed on the string clamp head is separated from the limit switch. The lateral clamp head comprises two lateral clamp arms for clamping the lateral sides of a racket frame to be strung by a pivotal movement accomplished by an actuating block sliding along a rotating bolt. The longitudinal clamp head comprises a clamping sheet with a rack extending downward from the bottom surface for meshing with a sector gear so as to be rotated by a handle in order to clamp the upper surface of the racket frame.

4 Claims, 6 Drawing Figures

RACKET FRAME CLAMP FOR STRINGING MACHINE

BACKGROUND OF THE INVENTION

Prior racket stringing machines generally are operated by experience without any information about the tension of the string to be tightened. The prior art disclosed by Franklin W. Held provides a device which can be stopped automatically when reaching a predetermined string tension during stringing, but the device is manually operated. U.S. Pat. No. 4,546,977 discloses a clamping device with fast locking ability, but it is suitable for only longitudinal clamping, lateral clamping is still to be developed.

SUMMARY OF THE INVENTION

It is the general object of the invention is to provide a racket stringing machine, which comprises two synchronized lateral clamping machanisms for locking quickly, the clamping forces exerted by the lateral clamping machanisms being equal and opposite each other.

According to the racket stringing machine of the invention, the lateral clamp head comprises: a supporting arm having a empty space located at the upper end; two lateral clamp arms pivoted on the supporting arm at opposite sides, the inner end of each of the clamp arms having an actuating element extending from the lower surface into the empty space; a bolt laterally passing through the supporting arm, an actuating block being received on the bolt in the empty space for driving the actuating element fixed on the lateral clamp arm; a spring received on the bolt and compressed between the inner wall of the supporting arm and the actuating block; a fixing element secured to the bolt end; and a cap for covering the empty space of the suporting arm by suitable screws.

DETAILED DESCRIPTION OF THE PREFERRED EMBODIMENT

Figure 1:
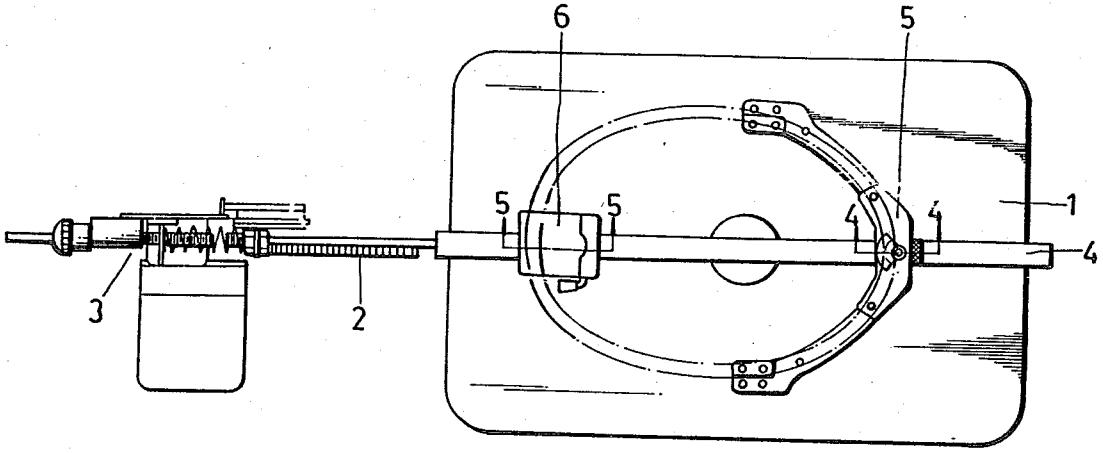
FIG. 1 is a top plan view of a preferred embodiment according to the invention.
Figure 2:
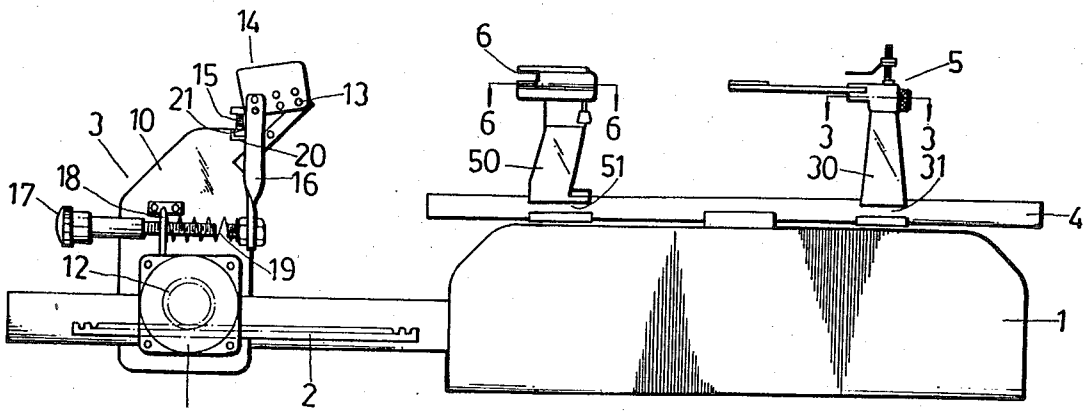
FIG. 2 is a side elevation of the apparatus of FIG. 1.

The racket stringing machine according to the invention as shown in FIGS. 1 and 2, comprises a substantially rectangular and planar support frame 1, a rack 2, a tension head assembly 3, a rotatable sliding rail 4, a lateral frame clamp 5 and a longitudinal frame clamp 6. Stringing is accomplished by engaging a string to be tightened in the tension head assembly 3, and electrically pulling it to the desired tension after the racket has been clamped to position by the lateral frame clamp 5 and the longitudinal frame clamp 6. The tension head assembly will stop automatically.

The tension head assembly 3 essentially comprises a vertical carrying plate 10, the central portion of which is fixed with a brake motor 11. The motor shaft 11 is fixed with a gear 12 engaged with the rack 2, whereby the tension head assembly 3 can move relative to the rack 2 by the relative motion between the gear 12 and the rack 2 when the brake motor 11 is actuated. A string clamp head 14 is mounted to a support arm which is fixed to the vertical plate 10 by a pin 13. The lower side of the string clamp head 14 is fixed with a contact element 15, and an actuating bracket arm 16 which extends downwardly is solidly mounted to the string clamp head 14 at a suitable position near the lower side thereof. An adjusting screw 17 is rotatably received in non-sliding relationship in the plate 10 and an indicating sheet 18 is screwed to the threaded portion of the adjusting screw 17. A helical coiled compression spring 19 is carried by the adjusting screw 17 and is compressed between the indicating sheet 18 and the actuating bracket arm 16. A limit switch 20 is fixed at the upper position of the supporting plate 10 while spring element 21 of the limit switch 20 normally contacts the contact element 15 of the string clamp head 14 so that the brake motor 11 can be actuated during operation. The motor 11 will be stopped actomatically when the contact element 15 moves upward and the spring element 21 of the limit switch 20 is let loose.

Figure 3:
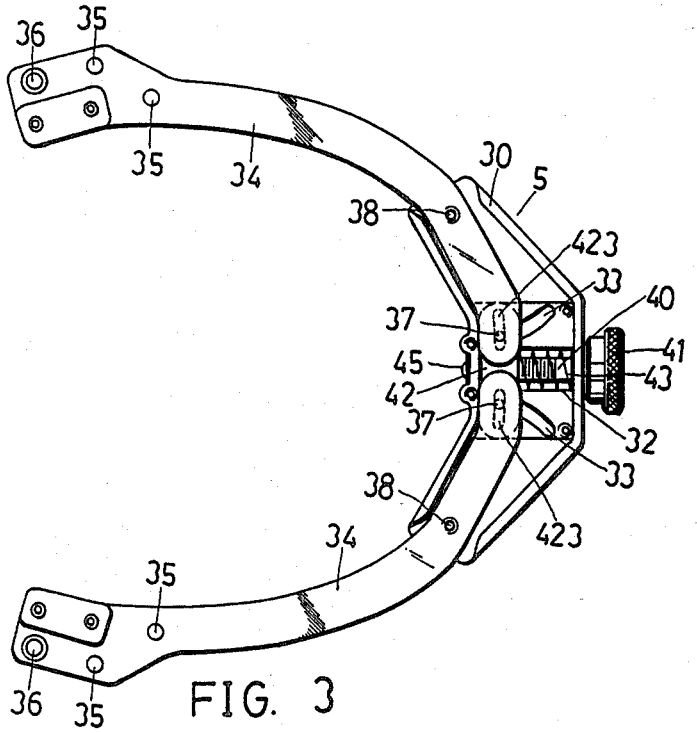
FIG. 3 is a partial cross-sectional view along line 3—3 of FIG. 2.
Figure 4:
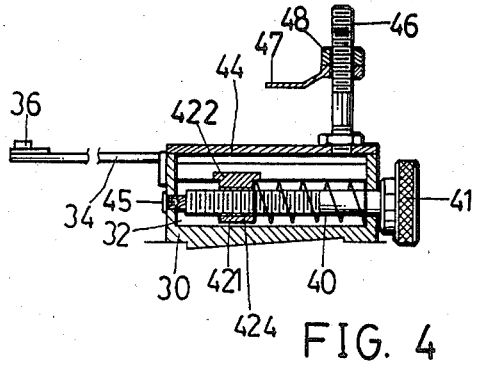
FIG. 4 is a partial cross-sectional view along line 4—4 of FIG. 1.

As shown in FIGS. 2, 3 and 4, the lateral frame clamp 5 comprises a supporting arm 30 slidably received on the sliding rail 4 by a sliding seat 31, so that the lateral frame clamp 5 is adjustable for clamping rackets of different sizes. An empty space 32 is formed in the upper surface of the supporting arm 30, and two guide passages 33 are provided at the bottom surface of the empty space 32. Two lateral clamp arms 34 have a predetermined curvature, and several holes 35 are provided at the free end of each of the arms 34 for changeably inserting a pin 36 in order to support racket frames of different sizes. The other end of each of the arms 34 is fixed with a pin 37 so that the other end of the pin 37 can be slidably guided along the guide passage 33, and the arms 34 are pivoted at the upper surface of the supporting arm 30 by two pivot pins 38. A bolt 40 passes through a side wall of the supporting arm 30, and into the empty space 32. The outer end of the bolt head 41 is located outside of the supporting arm 30, and the other end of the bolt is fixed by a screw 45, so that the bolt 40 is rotatably received in non-sliding relationship in the arm 30. An actuating block 42 which comprises a stub tube 421 and a substantially rectangular plate 422 fixed thereto is received on the bolt 40 in the empty space 32. And two slender holes 423 are provided in the plate 422. A threaded hole 424 of the stub tube 421 is engaged by the bolt 40 and each pin 37 passes through one of the holes 423 and into the guide passage 33. A compression spring 43 is located within the empty space 32 and received on the bolt 40, two ends of which contact against the inner wall of the supporting arm 30 and the actuating block 42 respectively. A cap 44 covers the empty space 32 by suitable screws, a bolt 46 is fixed on the upper surface of the cap 44, and a clamping sheet 47 and a nut 48 are slidably received on the bolt 46.

Figure 5:
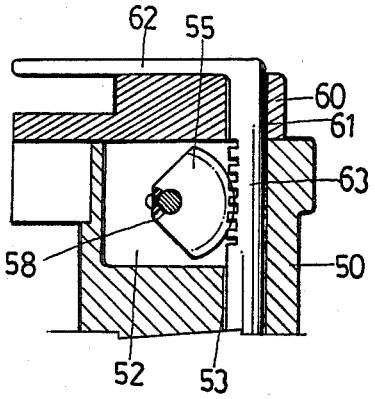
FIG. 5 is a partial cross-sectional view along line 5—5 of FIG. 1.
Figure 6:
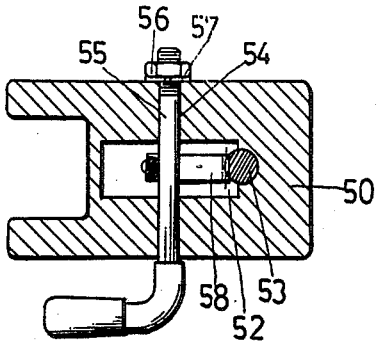
FIG. 6 is a cross-scetional view along line 6—6 of FIG. 2.

As shown in FIGS. 2, 5 and 6, the longitudinal frame clamp 6 comprises a supporting arm 50 and a sliding seat 51 fixed at the bottom thereof so that the frame clamp 6 is adjustably coupled to the sliding rail 4. A recess space 52 is located at the upper surface of the supporting arm 50 and a vertical guiding hole 53 is located beside and connected with the empty space. An axle hole 54 passes through the empty space 52 and an "L" shape handle 55 passes with one of its legs through the axle hole 54 and fixed at the end by a nut 56 and a spring washer 57, so that the handle 55 is rotatably received in non-sliding relationship in the arm 50. A gear 58 which is fixed on the handle 55 is cut into a sector, a cap 60 with a lead hole 61 relative to the guiding hole 53 covers the empty space 52 of the supporting arm 50 by a suitable screw and a clamping sheet 62 extends at suitable position with a rack 63 whereby the rack 63 passes through the lead hole 61 and enters the guiding hole 53.

In operation, first, a racket frame is placed on the lateral clamp head 5 and the longitudinal clamp head 6. For longitudinal clamping handle 55, and in turn the sector gear 58 are rotated so that the gear teeth of the gear 58 seperate from the teeth of the rack 63. The clamping sheet 62 is moved with respect to the racket frame, the handle 55 is rotated and the left portion of the racket frame will be clamped in position by the engagement and the relative motion between gear 58 and rack 63. The right portion of the racket frame can be then clamped by both longitudinal clamping sheet 47 and nut 48.

The lateral clamping process involves rotating the nut 41 so that the actuating block 42 slides axially relative to the bolt 40 and so that the two pins 37 will be pulled and guided along the guide passages 33 respectively. The two lateral clamp arms 34 are rotated with respect to the pivot pins 38 so that the pins 36 can clamp the outer surface of the racket frame.

After the racket frame has been clamped by the lateral clamp head 5 and longitudinal clamp head 6, stringing is accomplished by engaging the string to be tightened in the string clamp head 14, switching the backward switch on, in order that the brake motor 11 actuates the tension head assembly 3 backward (towards the left) along the rack 2. The string will be pulled tight by the string clamp head 14 until reaching a presetting tension preset by spring 19. Thereafter the string clamp head 14 will be caused to make a pivotal movement so as to release the spring element 21 of the limit switch 20, thereby signaling to the brake motor 11, the motor stops immediately and the tension head assembly 3 will be locked in fixed relationship to rack 2. At this point, a suitable string clamp (not shown) is moved into position adjacent the racket frame and clamps onto the string that is tensioned. The clamping action of the string clamp automatically locks it with respect to sliding rail 4 and maintains the tension on the string to allow release from the string clamp head 14 by switching the forward switch of the brake motor 11 on. The next tensioning operation is set up by pivoting the entire sliding rail 4 around to allow assembly 3 to grasp and pull the string in the opposite direction. Naturally, upon the next tensioning the string clamp will be utilized on the opposite side of the racket frame in the same manner described above, until all the strings have been strung.

The racket frame can be released by rotating the nut 41 in the opposite direction whereby the actuating block 42 will be pushed forward toward the racket frame so as to release the pins 36 relative to the racket frame by the pivot movement of the lateral clamp arm 34 with respect to the pivot pins 38. Next, the handle 55 is rotated in order to release the clamping sheet 62 by breaking the engagement relationship between the gear 58 and the rack 63. Finally, the nut 48 and the longitudinal clamping sheet 47 are loosened so that the racket frame can be taken out of the apparatus.

What is claimed is:

1. A lateral clamp head of a racket stringing machine comprising:

a vertically extending supporting arm having side walls defining an empty space located at an upper end of the arm and a lateral hole passing through the side walls;

two lateral clamp arms pivoted on the supporting arm at opposite sides, an inner end of each of the clamp arms having an actuating element extending into the empty space;

a bolt passing through the lateral hole of the supporting arm, an actuating block being received on the bolt in the empty space for driving the actuating elements on the lateral clamp arms;

a fixing element secured to one end of the bolt; and a cap for covering the empty space wherein the actuating block comprises a stub tube with a threaded hole receiving the bolt, and a plate fixed thereon, slender holes being provided in the plate.

2. The lateral clamp head of claim 1 wherein the actuating elements fixed on the lateral clamp arms are pins.

3. The lateral clamp head of claim 2 wherein guide passages are provided on the supporting arm with respect to the pins respectively.

4. A lateral clamp head of a racket stringing machine comprising:

a vertically extending supporting arm having side walls defining an empty space located at an upper end of the arm and a lateral hole passing through the side walls;

two lateral clamp arms pivoted on the supporting arm at opposite sides, an inner end of each of the clamp arms having an actuating element extending into the empty space;

a bolt passing through the lateral hole of the supporting arm, an actuating block being received on the bolt in the empty space for driving the actuating elements on the lateral clamp arms;

a fixing element secured to one end of the bolt; and a cap for covering the empty space wherein a spring is further provided and received on the bolt, and compressed between an inner wall of the supporting arm and the actuating block.

* * * * *